United States Patent [19]

Schroeder

[11] Patent Number: 5,016,531

[45] Date of Patent: May 21, 1991

[54] DOUBLE TRUCK PRINTING REGISTRATION SYSTEM FOR A ROTARY PRINTING PRESS

[75] Inventor: Richard B. Schroeder, Wilmington, Del.

[73] Assignee: Hercules, Incorporated, Wilmington, Del.

[21] Appl. No.: 298,988

[22] Filed: Jan. 19, 1989

[51] Int. Cl.[5] ..... B41F 27/06; B41F 27/12

[52] U.S. Cl. ..... 101/415.1

[58] Field of Search ..... 101/415.1, 378, DIG. 36

[56] References Cited

U.S. PATENT DOCUMENTS

| | | | |
|---|---|---|---|
| 3,858,512 | 1/1975 | Simeth | 101/DIG. 36 |
| 3,882,775 | 3/1980 | Lytle et al. | 101/415.1 |
| 4,603,641 | 8/1986 | Jeschke et al. | 101/415.1 |
| 4,748,911 | 6/1988 | Kobler . | |

FOREIGN PATENT DOCUMENTS

| | | |
|---|---|---|
| 0229892 | 10/1986 | European Pat. Off. . |
| 400204 | 10/1933 | United Kingdom . |
| 1083331 | 9/1967 | United Kingdom . |

*Primary Examiner*—J. Reed Fisher

*Attorney, Agent, or Firm*—Connolly & Hutz

[57] ABSTRACT

A rotary printing press is used for printing standard pages and for double truck printing of the centerfold page. This is accomplished by mounting side by side printing plates to locking devices in the rotary printing press. The printing plates are positioned by two registrations which are selectively movable toward and away from each other to one of at least two predetermined fixed positions. In one of the fixed positions, the standard printing takes place, and in the other fixed position, the printing press is used for double truck printing.

16 Claims, 5 Drawing Sheets

DOUBLE TRUCK PRINTING REGISTRATION SYSTEM FOR A ROTARY PRINTING PRESS

BACKGROUND OF INVENTION

Rotary printing presses are used for various purposes including newspaper printing. Each section of a newspaper is comprised of standard pages wherein a margin exists along the sides of each page. The centerfold page however does not require a margin and in fact it is sometimes desirable that there be no margin so that various printed material could span the central area of the centerfold page and print a continuous image. Heretofore, the prior art has printed newspapers by utilizing conventional techniques for printing the standard pages. When the double truck page is printed, however, it is necessary to have each half of the centerfold butted together. This is conventionally done manually with special equipment and involves such manual activities as sheering, trimming and punching. Such equipment is quite costly, being about $40,000, in addition to requiring the great manual effort.

SUMMARY OF INVENTION

An object of this invention is to provide a rotary printing press which is capable of printing both standard pages and double truck pages without requiring the great manual efforts or equipment costs heretofore required.

In accordance with this invention, the rotary printing press includes at least two plate locking devices for releaseably locking side by side printing plates to the plate cylinder. Each plate locking device include registration means to properly orient each printing plate. The registration means are mounted in such a manner as to be slightly shiftable to one of two predetermined fixed positions. In one of these positions the registration means of the two adjacent locking devices are shifted away from each other and the printing press is used for printing standard pages. In the other of the two positions, where the registration means are moved toward each other the printing press is used for double truck printing.

In a preferred embodiment of this invention and the registration means is in the form of a registration plate having an offset generally perpendicular flange which is secured by a fastener to the housing of the plate locking device. The opposite end of the registration plate includes plate registration structure. The printing plate would have complementary structure to properly orient the printing plate. The fastener could be manipulated so that the registration plate can be shifted to one of the two positions in accordance with the type of printing being performed. The fastener would then be tightened to lock the registration plate in that position.

THE DRAWINGS

DETAILED DESCRIPTION

Figure 1:
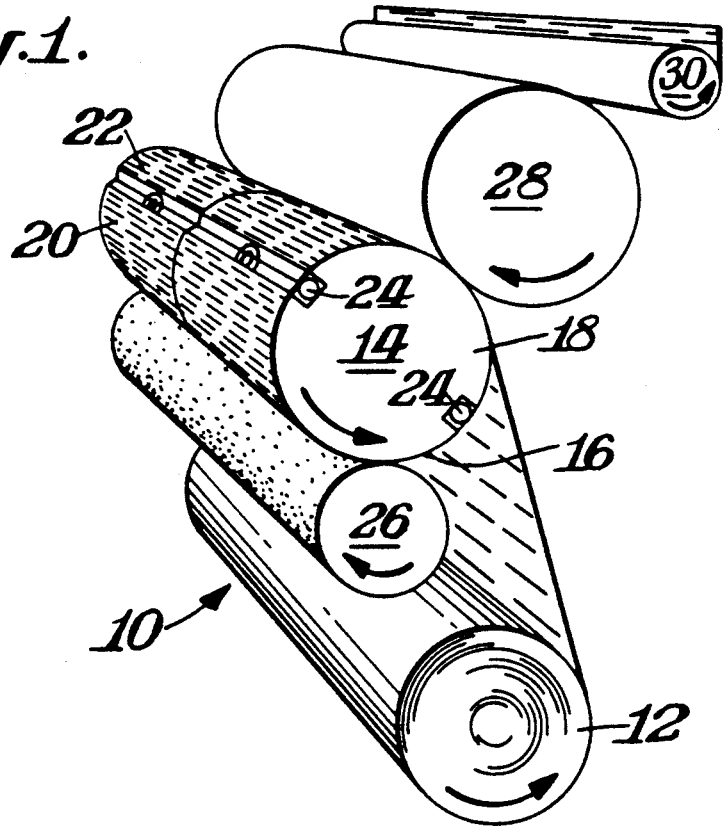
FIG. 1 is a perspective view showing a rotary printing press in accordance with this invention.

FIG. 1 illustrates a rotary printing press 10 in accordance with this invention. As shown therein printing press 10 includes a roll of paper supply 12 which may be used for printing newspapers. Printing press 10 also includes plate cylinder 14. Plate cylinder 14 may be considered as being in two sections for mounting side by side printing plates which are used for printing the newspapers. In the embodiment illustrated in FIG. 1, two such printing plates 16,18 are secured to one section of plate cylinder 14 while a corresponding pair of printing plates 20,22 is secured to the other half or section of plate cylinder 14. The printing plates are secured to the plate cylinder by sets of plate locks 24,24. Plate locks 24,24 may be of any suitable construction. For example, the plate locks may be of the known Barenschee Universal Torsion Cylinder Plate Lock construction. The plate locks may also be of the form described in my patent application Ser. No. 65,951 filed June 24, 1987 the details of which are incorporated herein by reference thereto.

Rotary printing press 10 also includes an ink cylinder 26 and an impression cylinder 28 as well as backing roll 30.

It is to be understood that the press 10 illustrated in FIG. 1 is merely exemplary and other forms of presses may be used with the invention.

Figure 2:
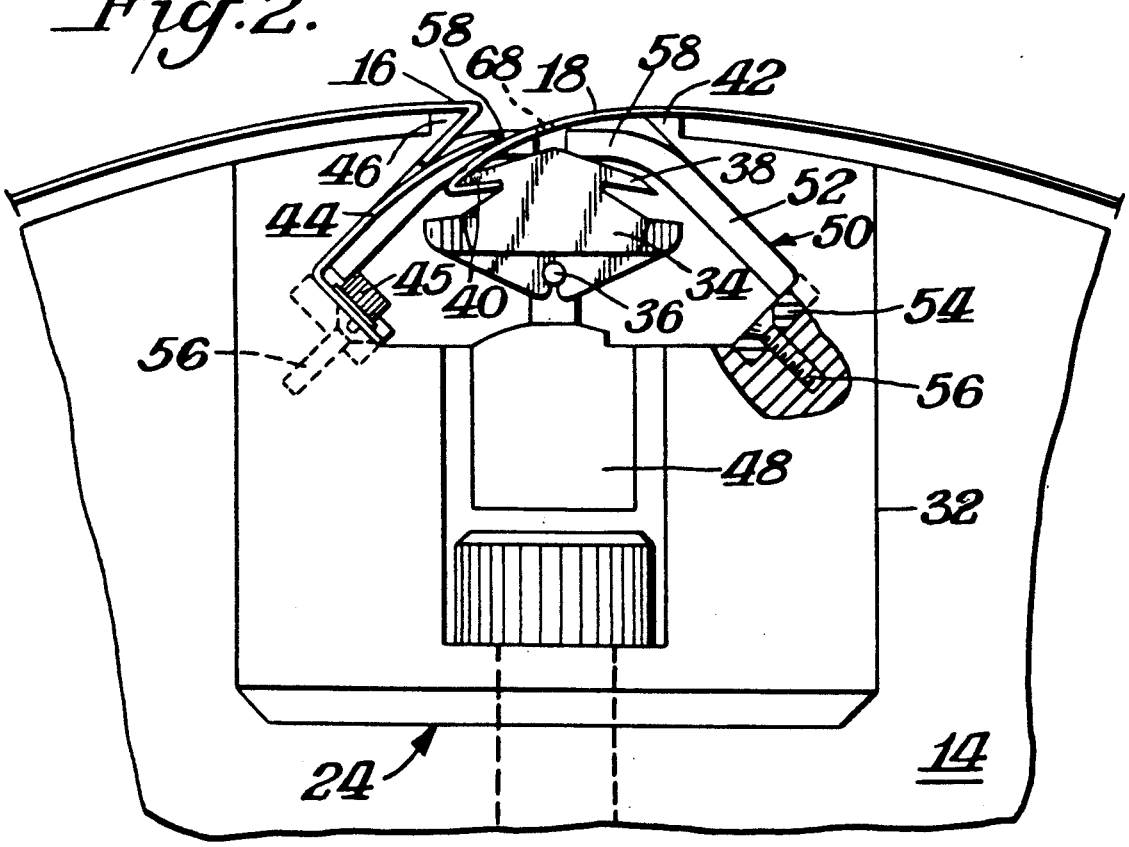
FIG. 2 is an end elevation view, partly in section of a portion of the printing press shown in FIG. 1.

FIG. 2 illustrates in greater detail the structure of plate lock 24. Plate cylinder 14 would be provided with four of these plate locks with a pair of plate locks aligned with each other and diametrically opposite the other pair. (See FIG. 1) As shown in FIG. 2 each plate lock 24 is in the form of, for example, a metal housing 32 which is mounted in a channel in plate cylinder 14. The particular plate lock 24 illustrated in FIG. 2 is of the K&F FLEX LOCK Cylinder Plate Lock construction and includes a spindle 34 pivotally mounted on fixed shaft 36 which is secured to bar 48. A spring, not shown, biases spindle 34 to the position shown in FIG. 2. Spindle 34 is provided with a pair of shoulders 38,40. An end of printing plate 16 fits over fixed edge 46 of housing 32. As later described, an end of printing plate 18 passes over edge 42 of housing 32 and fits over shoulder 40 of spindle 34. Leaf spring 44 presses against the end of printing plate 18 to firmly hold the leading end of printing plate 18 in position. FIG. 2 illustrates a fastener 45 for mounting leaf spring 44 to housing 32. This manner of mounting the printing plates is well known in the art. An alternative locking arrangement may utilize my invention of application Ser. No. 65,951 where the printing plate has a double bend to facilitate the printing plate being locked in place.

Figure 4:
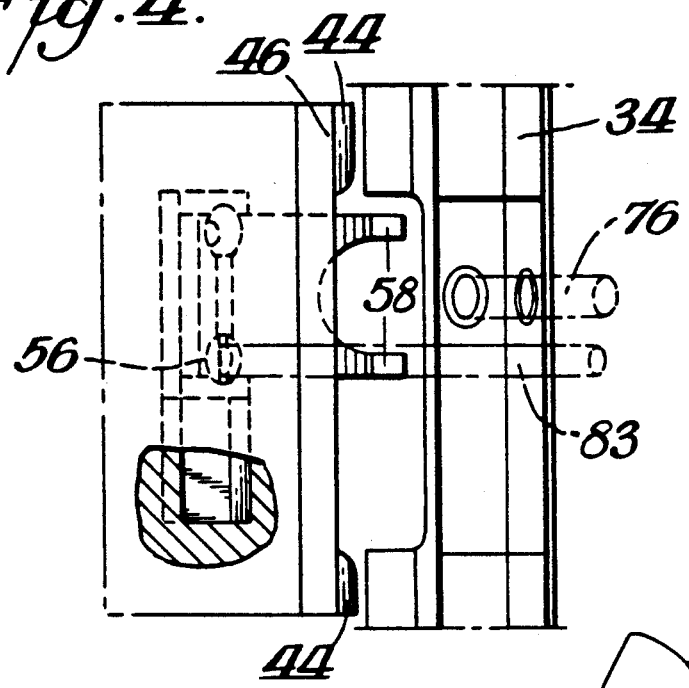
FIG. 4 is a top plan view, partly in section of the registration means in the printing press of FIGS. 1-3.

Each printing plate is held laterally in its proper position on plate cylinder 14 by registration means 50. Specifically, a registration means would be provided for each of the leading end and trailing end of each printing plate. In the embodiment of FIG. 1 where four printing plates are used, eight registration means 50 would be provided. Each registration means 50 is generally of the form which includes a registration plate 52 having an offset perpendicular flange or base portion 54 which is secured by fastener 56 to housing 32. The opposite end of registration plate 52 is in the form of a pair of pins or fingers 58. (See also FIG. 4).

It is to be understood that although the registration means is illustrated as centrally located, other locations can be used. Similarly structure other than pins or fingers may be used as long as the registration means includes structure which cooperates with complementary structure on the printing plate to properly locate or register the printing plate.

The following describes the problem with which the present invention is concerned. A newspaper would have the material printed thereon from a pair of printing plates. The leading edge and the trailing edge of each plate would include a notched portion.

Figure 3:
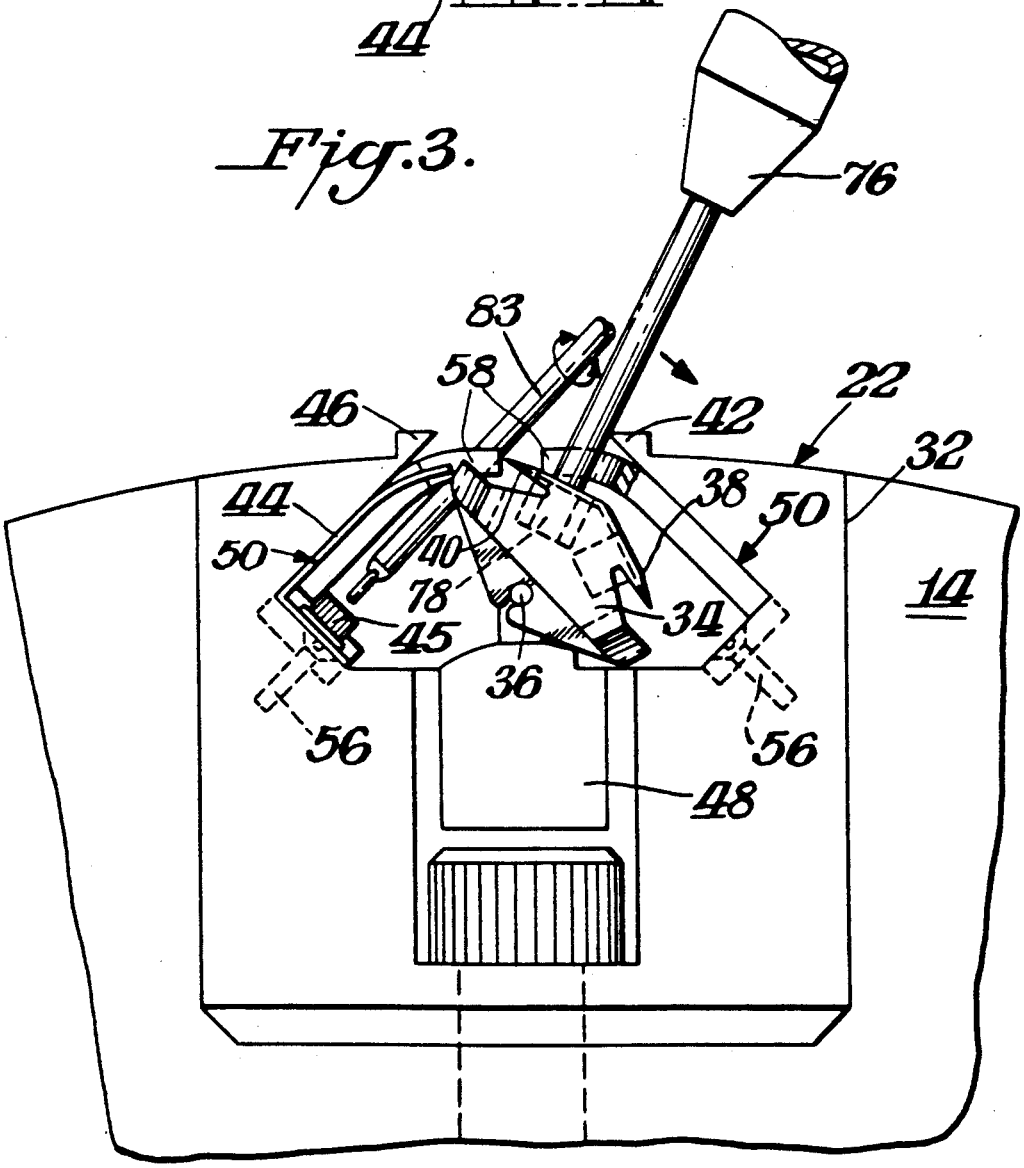
FIG. 3 is an end elevation view showing the manipulation of the registration means in the printing press of FIGS. 1-2.
Figure 6:
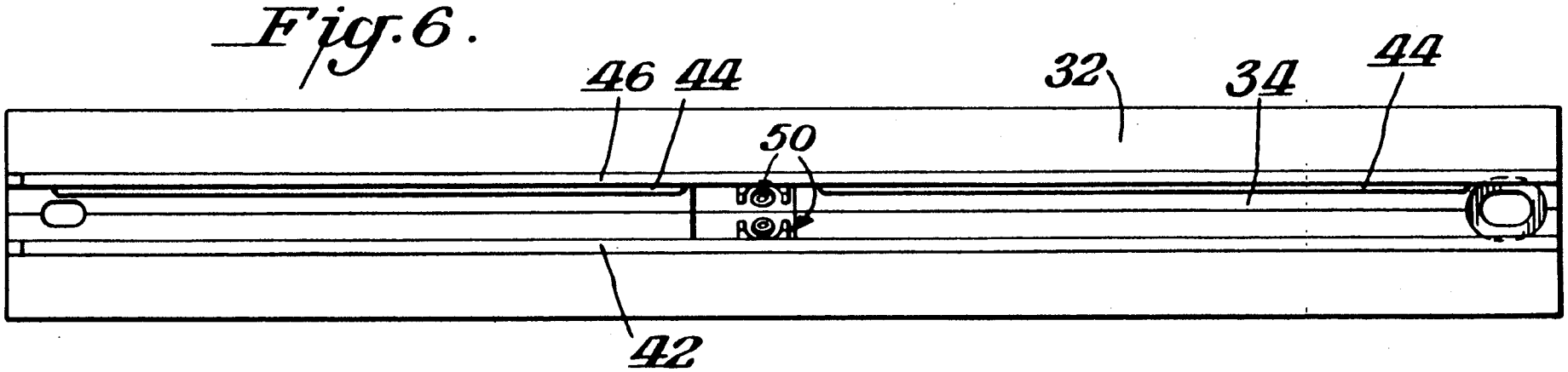
FIG. 6 is a top plan view of the plate lock shown in FIG. 5.
Figure 5:
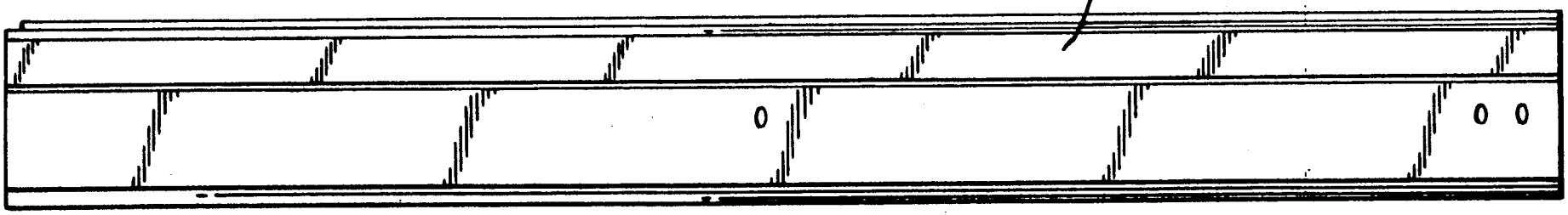
FIG. 5 is a front elevation view of a plate lock used in the printing press of FIGS. 1-4.

The following describes the method used for mounting printing plates on the plate cylinder 14. The bent leading edge of a printing plate such as printing plate 16 would be snapped over fixed edge 46 of lock housing 32 as illustrated in FIG. 2. The trailing edge would then be secured to the diametrically opposite plate lock 24. This would be accomplished by pivoting spindle 34. FIG. 3, for example, illustrates the insertion of the manipulating tool 76 in a recess 78 in spindle 34 which permits spindle 34 to be pivoted about shaft 36. The trailing edge of the printing plate would then be snapped over movable edge or shoulder 40 which is possible because of the slack resulting from the dimension of the printing plate being slightly longer than the arcuate distance from fixed edge 46 of one lock 24 to the diametrically opposite lock 24. After the trailing edge of plate 18 is mounted over movable edge 40 manipulating tool 76 is shifted in a counter-clockwise direction to permit the spring biased spindle 34 to return to its normal position which is illustrated in FIG. 2. During this motion, the slack is taken up and the printing plate is held in a taut condition. Each printing plate 16, 18, 20 and 22 would be mounted in this manner. During the positioning of each printing plate on the locks 24 the registration notch 68 of each printing plate is placed over the registration structure, such as pins or fingers 58 with the outer edges of each registration pin or finger contacting complementary structure, such as notch 68 since the width of each notch corresponds to the distance between the outer edges of each set of fingers 58. Accordingly, registration fingers 58 serve to properly orient or locate each printing plate on plate cylinder 14.

It is to be understood that the above manner of mounting the printing plates is known in the art. The invention, however, utilizes the concept of shifting the registration means to one of two fixed positions. One of the fixed positions would correspond to a spacing of the plates wherein the plates are spaced apart from each other for printing standard pages. The other of the two fixed positions would correspond to wherein the plates are shifted toward each other so that the image areas 74 are in abutment. As a result, it would be possible to have the two image areas 74,74 contain continuous material 75 (see FIGS. 8 and 10) since the net result is to give the impression of one continuous sheet being printed rather than two separate sheets.

Figure 7:
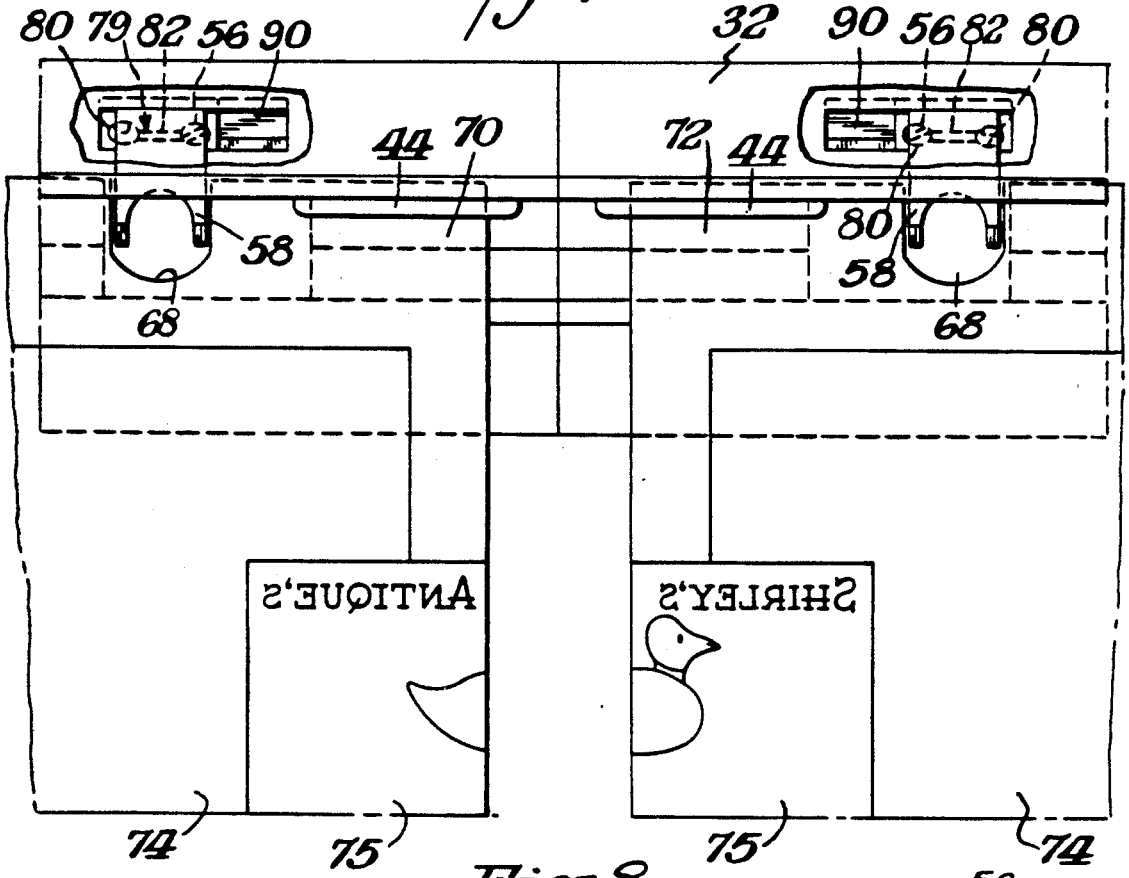
FIGS. 7-8 are front elevation views schematically shown the shifting of the registration means to two fixed positions.
Figure 8:
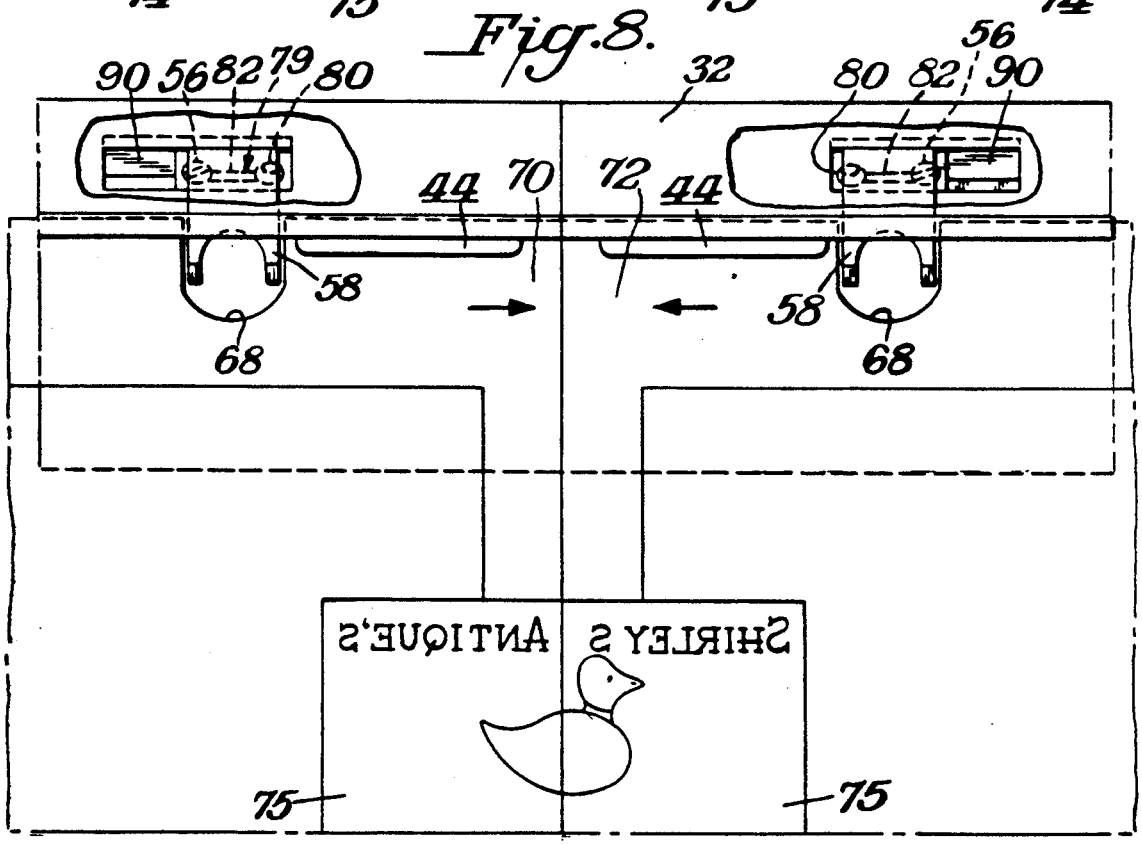

FIGS. 7–8 illustrate one embodiment for practicing this invention. As shown therein, base portion 54 of registration means 50 includes a track 79 formed by a pair of countersunk-counterbores 80,80 which are interconnected by a slot 82. Fastener 56 which may simply be a screw is dimensioned such that the diameter of its threaded portion generally corresponds to the width of slot 82 while the head portion of fastener 56 generally corresponds to the diameter of each countersink-counterbores 80,80. Accordingly, when fastener 56 is loosened the entire plate 52 may be laterally shifted until fastener 56 is in either of the countersunk-counterbores 80,80. When the fastener 56 is tightened the top surface of its head would be flush with base portion 54, as shown in FIG. 2. The distance between the countersunk-counterbores 80,80 would correspond to one-half of the Figure distance between the plate so that a shifting of the registration means in the adjacent sets of locks 24,24 toward each other would result in the image areas 74,74 abutting against each other and have a continuous printed image 75. FIG. 7 illustrates the condition of plates 70,72 before the shifting, while FIG. 8 illustrates the condition of plates 70,72 after the shifting. In the illustrated embodiment access is had to fastener 56 by pivoting spindle 34 as illustrated in solid lines in FIG. 3 so that a screwdriver 83 or other manipulating tool may be inserted directly into the slotted head of fastener 56. Registration means 50 may then be shifted in any suitable manner such as by pushing against the exposed pins or fingers 58. Base portion 54 is mounted in recess 90 which also limits the extent of its sliding motion.

Figure 9:
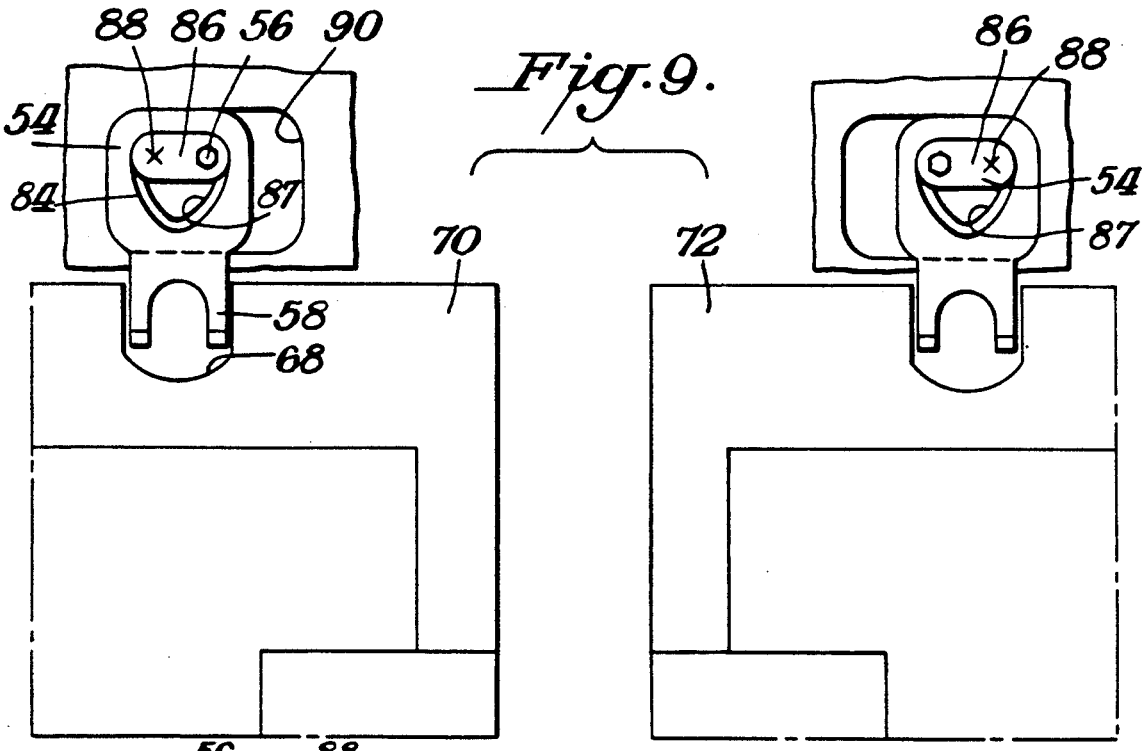
FIGS. 9-10 are views similar to FIGS. 7-8, but showing an alternative embodiment of this invention.
Figure 10:
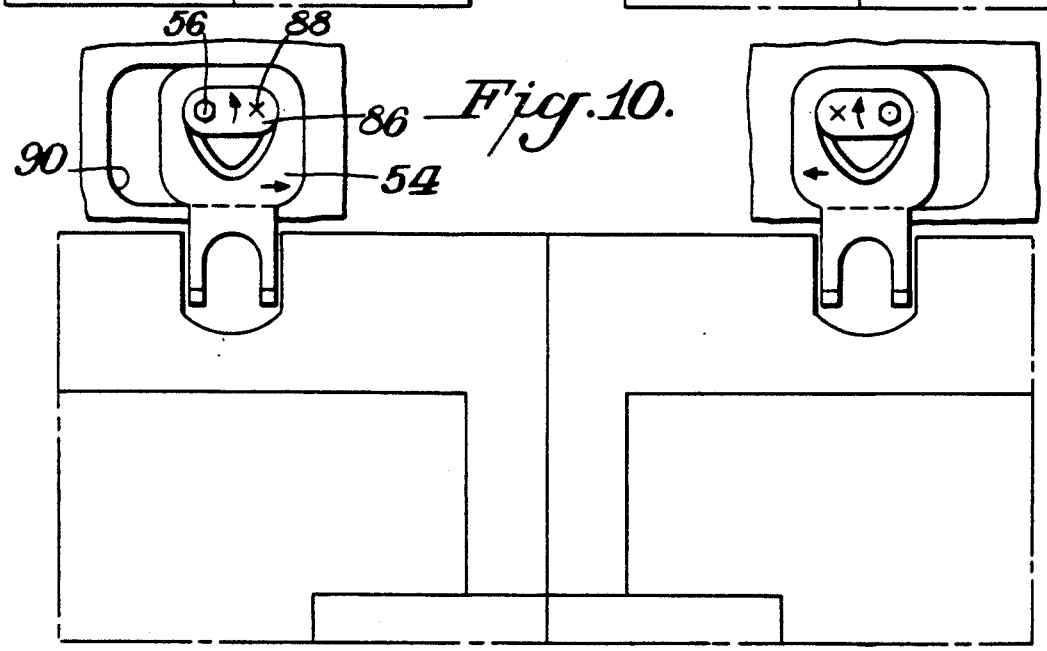
Figure 11:
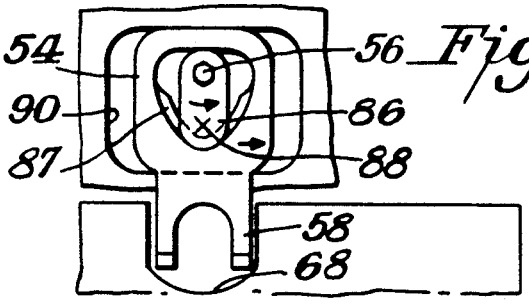
FIG. 11 is a view similar to FIGS. 9-10 showing an intermediate phase of operation.

FIGS. 9–11 illustrate an alternative manner of shifting the registration means. As shown therein in place of the holes and slot of the FIGS. 7–8 embodiment, a cam track 84 is provided which is formed by an irregular shaped hole or opening in base portion 54 of registration means 50. Fastener 56 would extend through a cam 86 riding in cam track 84. A semi-circular web or retainer 87 is in cam track 84 to orient cam 86 in its horizontal position. FIG. 9 illustrates the position of the various parts when the plates 70,72 are spaced apart as in FIG. 14. In this position cam 86 is located in contact with the upper edge of cam track 84 and in contact with retainer 87. In order to move plates 70,72 to their double truck or abutting position fastener 56 would be loosened and cam 86 would be rotated. Such rotation would be done in any suitable manner, such as inserting a manipulating tool into opening 88. FIG. 11 illustrates the intermediate position of cam 86 where cam 86 is completely over retainer 87. FIG. 10 illustrates the final position where cam 86 is again in contact with the upper edge of cam track 84 and with retainer 87.

As shown in FIGS. 9–11 the fixed positions of registration means 50 is also determined by means of a slot 90 in which the registration plate 52 rides. Thus, in FIG. 9 registration plate 50 is at the outer most end of each slot 90 while in FIG. 10 the registration plates are at the inner most ends of each slot.

In FIGS. 7–8 the counterbores 80,80 may be considered as stop surfaces which are contacted by fastener 56 which may be considered a contact member to define the two positions or registration means 50. Similarly in the embodiment of FIGS. 9–11 the opposite edges of cam track 84 may be considered stop surfaces and the portion of cam 86 remote from fastener 56 may be considered a contact member to define the two positions.

Although this invention has been particularly described with respect to shifting the printing plates by shifting the registration means, such shift of the registration means may be accomplished in other manners.

Although the invention has been described with respect to two fixed positions, any number of predetermined plural positions may be used. Additionally, the invention may be practiced with two adjacent plates in the double truck position and the other adjacent plates used with the same plate locks still in the standard position. If necessary for a specialized printing operation the invention may be practiced by moving only one registration device.

As can be appreciated the present invention thereby provides a simple means wherein the same rotary printing press can be used for printing standard pages of a newspaper and then with a minor adjustment the printing plates can be moved into abutment with each other for the double truck printing operation. The standard and double truck printing plates can be processed through the same register trim, bender machine. No special equipment or additional manning is required to process double truck plates through platemaking or trim-bending the plates ready for press.

What is claimed is:

1. In a rotary printing press having a plate cylinder with two aligned locking means in a peripheral channel in the plate cylinder for releaseably locking a pair of side by side printing plates to the plate cylinder, one of said locking devices being provided for each respective printing plate, and each locking means having registration means engaged with complementary registration structure in its printing plate for orienting its printing plate laterally on the plate cylinder, the improvement being in that a housing is in said channel for each of said locking means, said registration means including two spaced stop surfaces defining two positions, one of said two positions being a single truck position and the other of said positions being a double truck position, said double truck positions of said two locking means being disposed toward each other and said single truck positions of said two locking means being disposed remote from each other, a contact member for each of said registration means, each of said registration means of said two aligned locking means being laterally slidably mounted in its respective housing to selectively dispose its said contact member in contact with said two stop surfaces, the adjacent sides of said side by side printing plates being spaced from each other when both of said registration means are in their said single truck positions for standard printing, and said adjacent sides of said side by side printing plates abutting each other when both of said registration means are in their double truck positions for double truck printing to permit the forming of a continuous joint image from said side by side printing plates.

2. In the printing press of claim 1 wherein said registration means includes a registration plate having a base portion at one end thereof slidably mounted to said housing, the opposite end of said registration plate being exposed from said housing, and registration structure connected to and extending from said opposite end of said registration plate engaging said complementary registration structure.

3. In the printing press of claim 2 wherein said registration structure comprises a pair of pins, and a manipulatable fastener slidably connecting said base portion to said housing.

4. In the printing press of claim 3 wherein said base portion comprises a flange generally perpendicularly extending from said registration plate, said pins being curved fingers bent toward said base portion, said complementary registration structure being a notch in its said printing plate, and said pins being in said notch.

5. In the printing press of claim 4 wherein a pair of said registration means is mounted to said housing for orienting the leading end of one of said respective printing plates and the trailing end of the other of said respective printing plates.

6. In the printing press of claim 5 including an elongated spindle pivotally mounted in said housing, an end of said printing plate being disposed over a movable edge in the form of a shoulder on said spindle, and said fastener being exposed for manipulation upon the pivoting of said spindle.

7. In the printing press of claim 6 wherein said base portion includes a track in the form a pair of countersunk-counterbores interconnected by a slot, a hole in said housing engaged by said fastener, said fastener being mounted in said track whereby said fastener may be loosened to permit said registration plate to slide until said fastener is selectively in one of said countersunk-counterbores and in said hole, said counterbores being said stop surfaces, and said fastener being said contact member.

8. In the printing press of claim 6 wherein said base portion includes a cam track, a cam positioned in said cam track, and said fastener mounting said cam to said housing whereby loosening of said fastener permits said cam to be shifted to cause said registration plate to slide to one of said two positions.

9. In the printing press of claim 1 wherein at least two sets of diametrically opposed locking means are mounted on said plate cylinder totaling at least four locking means, and each of said locking means means having two opposed registration means whereby the leading end of one of said respective printing plates and the trailing end of the other of said respective printing plates may be mounted to the same locking means.

10. In the printing press of claim 1 wherein said registration means includes a base portion having a pair of spaced bores, a hole in said housing, said base portion being slidably mounted for selective alignment of said bores with said hole, said spaced bores comprising said stop surfaces, a fastener detachably engaged in said hole and its aligned one of said bores, and said fastener comprising said contact member.

11. In the printing press of claim 10 wherein said bores are countersunk-counterbores interconnected by a slot.

12. In the printing press of claim 8 wherein said cam track includes a pair of spaced walls which comprise said stop surfaces, and said cam comprising said contact member.

13. In the printing press of claim 12 wherein aid base portion is slidable in a slot and selectively disposed against opposite ends of said slot when said registration means is in said two positions.

14. In the printing press of claim 1 wherein said registration means includes a base portion, a cam track in said base portion, a cam positioned in said cam track, and a fastener mounting said cam to said housing whereby loosening of said fastener permits said cam to be shifted to cause said registration plate to slide to one of said two positions.

15. In the printing press of claim 14 wherein said cam track includes a pair of spaced walls which comprise said stop surfaces, and said cam comprising said contact member.

16. In the printing press of claim 15 wherein said base portion is slidable in a slot and selectively disposed against opposite ends of said slot when said registration means is in said two positions.

* * * * *

UNITED STATES PATENT AND TRADEMARK OFFICE

CERTIFICATE OF CORRECTION

PATENT NO. : 5,016,531

DATED : May 21, 1991

INVENTOR(S) : Richard B. Schroeder

It is certified that error appears in the above-identified patent and that said Letters Patent is hereby corrected as shown below:

Col. 1, line 45, delete "and";

Col. 4, line 15, "plate" should read --plates--;

Col. 2, line 9, after "invention" insert --and--;

In the Claims, Col. 6, line 49, "aid" should read --said--.

Signed and Sealed this

Twelfth Day of January, 1993

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 5,016,531

DATED : May 21, 1991

INVENTOR(S) : Richard B. Schroeder

It is certified that error appears in the above-identified patent and that said Letters Patent is hereby corrected as shown below:

Column 6, Claim 9, line 30, "locking means means" should read --locking means--.

Signed and Sealed this

Ninth Day of November, 1993

*Attest:*

*Attesting Officer*

BRUCE LEHMAN

*Commissioner of Patents and Trademarks*